United States Patent [19]

Wallwork

[11] 4,398,951

[45] Aug. 16, 1983

[54] FERMALLOY(FE-MN-AL STAINLESS STEEL)

[75] Inventor: Greig R. Wallwork, Sydney, Australia

[73] Assignee: Unisearch Limited, Kensington, Australia

[21] Appl. No.: 367,800

[22] Filed: Apr. 12, 1982

[30] Foreign Application Priority Data

Apr. 22, 1981 [AU] Australia ..... PE8543

[51] Int. Cl.[3] ..... C22C 39/02; C22C 37/10

[52] U.S. Cl. ..... 75/124

[58] Field of Search ..... 75/124 E, 124 F

[56] References Cited

U.S. PATENT DOCUMENTS

| | | | |
|---|---|---|---|
| 1,850,953 | 3/1932 | Armstrong | 75/124 E |
| 3,684,493 | 8/1972 | Kubota et al. | 75/124 E |
| 3,690,870 | 9/1972 | Williams | 75/124 E |
| 3,698,964 | 10/1972 | Caule et al. | 75/124 E |
| 3,754,898 | 8/1973 | McGurty | 75/124 F |
| 3,852,063 | 12/1974 | Niimi et al. | 75/124 F |

*Primary Examiner*—Veronica O'Keefe

*Attorney, Agent, or Firm*—Holman & Stern

[57] ABSTRACT

The invention provides corrosion-oxidation resistant alloys based on iron, using aluminum (usually about 4 to about 9% by weight) as the element which prevents corrosion/oxidation, and manganese (usually about 3 to about 15% by weight) and containing from 0 to about 6% chromium. The alloys are referred to collectively as "Fermalloys". The invention provides alloys with high ductility at working temperatures and reasonable malleability at room temperature. Some scale deterioration that may occur on these rather simple alloys can be eliminated using minor additions of rare earth elements and some degree of high temperature strengthening may also be possible by the addition of carbon to form carbides.

9 Claims, 10 Drawing Figures

Figure 1:
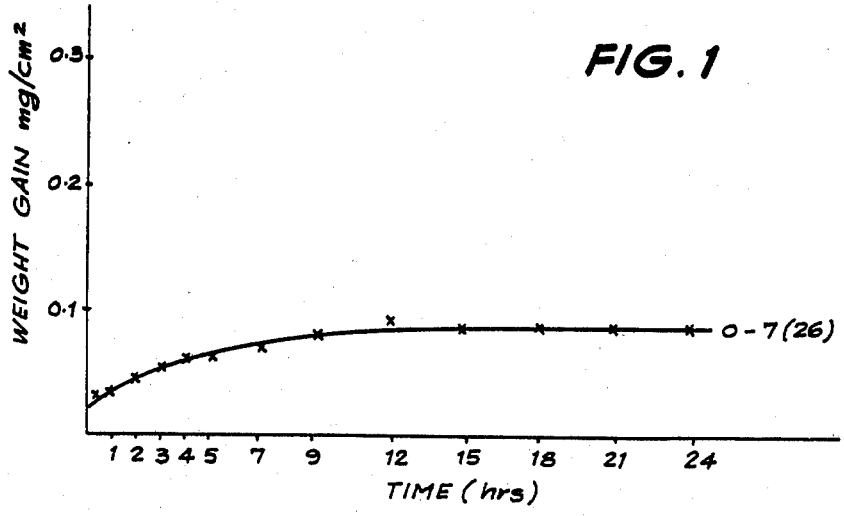

WEIGHT GAIN mg/cm²
0.3
0.2
0.1
0-7 (26)
1 2 3 4 5 7 9 12 15 18 21 24
TIME (hrs)

WEIGHT GAIN mg/cm²
0.8
0.6
0.4
0.2
1-6 (25)
1-7 (28)
1-8 (54)
1 2 3 4 5 7 9 12 15 18 21 24
TIME (hrs)

0·2
0·1
2·5-6 (56)
2·5-7 (50)
2·5-9 (22) 10,3
1 2 3 4 5 7 9 12 15 18 21 24
TIME (hrs)
WEIGHT GAIN mg/cm²

0·2
0·1
5-6 (65)
5-8 (63) 7, 9
1 2 3 4 5 7 9 12 15 18 21 24
TIME (hrs)

FERMALLOY(FE-MN-AL STAINLESS STEEL)

The present invention relates to novel corrosion-oxidation resistant alloys based on iron, using aluminium as the element which prevents corrosion/oxidation, and manganese as the ternary alloying element which is added to promote physical properties.

Steels possessing a high strength, along with good corrosion resistance and high oxidation resistance are desirable for many applications. For many such uses it is desirable that the steel be readily hot and cold formable and have good tensile and impact ductile properties.

Many products, when in service, must operate at elevated temperatures under oxidizing conditions. To be satisfactory when subjected to such conditions, a steel should, in general, be resistant to scaling, have thermal coefficients of expansion as low as possible so the products do not change in shape substantially at temperatures varying from room temperatures to the higher temperatures involved by their intended use, be resistant to corrosion, and have the ability to cause any scale that does form on its surface to be a tightly adherent layer having little or no tendency to flake off and cause trouble.

Aluminium is known to provide good scaling properties at high temperatures, but prior art steels containing sufficient aluminium to provide enhanced resistance to corrosion or scaling at high temperatures have had poor ductility and cold forming properties.

The corrosion resistance of commercial stainless steels is due to the addition of chromium to the alloy in amounts which vary from about 12 to about 40%. Since the corrosion resistance of stainless steel is related to the chromium content, it is well accepted that those stainless steels having large amounts of chromium are usually superior in corrosion resistance to those having lesser amounts.

In addition to being one of the major constituents for oxidation and corrosion resistance, chromium is also the principal cost element in most commercial stainless steels.

Because of the relatively high cost of chromium, there are continuing efforts to find replacements for at least a portion of the chromium by other cheaper elements that would reduce production costs yet maintain a reasonably high degree of oxidation and corrosion resistance.

It is well known that silicon and aluminium are suitable alternatives when used in concentrations which promote the formation of protective $SiO_2$ or $Al_2O_3$ scales. Silicon appears to be an unlikely choice due to its tendency to promote severe brittleness and because it favours the precipitation of sigma phase when added to Fe-Cr alloys. At elevated temperatures $SiO_2$ may react to form molten oxides or be reduced to form volatile SiO. Aluminium, apart from being abundant and cheap, oxidises to form scales which are stable to much higher temperatures than $Cr_2O_3$ scales which can be reduced to volatile $CrO_{3(g)}$ at temperatures above 900° C. The major objection to the use of aluminium as an alternative has been the comparative brittleness that occurs upon its addition to iron in sufficient quantity for the formation of protective scales.

In "Stress Effects and the Oxidation of Metals" by G. R. Wallwork and M. B. McGirr (1975) Ed. Cathcart J. V., Met. Soc. AIME, New York, p 262, research into the development of high temperature alloys showed the suitability of using Fe-Al alloys as a base for further development.

One group of alloys which has been developed is referred to as Fecralloy steels. Fecralloy steels are a family of steels containing chromium, aluminium, and yttrium. They have good oxidation resistance at high temperatures, particularly over the range 700°-1200° C. Their compositions lie within the range:

| | | |
|---|---|---|
| C | ≦ | 0.03% |
| Si | | 0.2-0.4% |
| Cr | | 15.0-22.0% |
| Al | | 4.0-5.2% |
| Y | | 0.05-0.4% |

It is an object of this invention to provide alloys which are less expensive than stainless steels.

It is a further object of the present invention to provide alloys which give equal, or superior, oxidation resistance when compared to stainless steels at high temperatures.

It is another object of the present invention to provide alloys containing aluminium which combine good oxidation resistance at high temperatures along with high strength, good tensile and impact ductility and good hot and cold forming properties. It is also an object to provide such properties with the use of less expensive alloying elements.

It is yet another object of the present invention to provide alloys which do not require special processing techniques or equipment.

Other objects and advantages of the invention will become apparent to those skilled in the art by reference to this specification as a whole.

In one aspect the present invention provides alloys based on iron, using aluminium as the element which prevents corrosion/oxidation, and manganese as the ternary alloying element which is added to promote physical properties. Such alloys are herein termed as "FERMALLOYS".

In one aspect the invention provides an alloy comprising by weight from about 4 to about 9 percent aluminium, about 3 to about 15 percent manganese, from 0 to about 6 percent chromium and the balance essentially iron.

The alloys of the present invention provide an alternative to heat-resisting stainless steels using chromium, i.e. steels based on Fe-Ni-Cr, and other steels coated with aluminides. They are cheaper to make with better oxidation/corrosion resistance than stainless steels in many circumstances. The strength of alloys of the present invention, particularly for high temperature applications, may be varied by the addition of other alloying elements such as carbon and titanium and rare earth elements. In addition, various heat treatment processes may be applied to improve the properties of the alloys for certain applications.

The alloys of the present invention tend to form an $Al_2O_3$ scale for protection, as compared with $Cr_2O_3$ formed on stainless steels. Previously developed Fe-Cr-Al alloys (termed fecralloys) also form $Al_2O_3$ scales but in the fermalloys of the present invention manganese is used to replace chromium.

The invention will be further described with reference to the following description of preferred embodiments of the invention, illustrated with particular reference to Tables I and II and FIGS. 1-10, in which:

Table I indicates the various nominal alloy compositions referred to in FIGS. 1–10.

Table II indicates the weight gains per 24 hours for the various alloy compositions at 800° C. and 200 Torr oxygen pressure.

Figure 2:
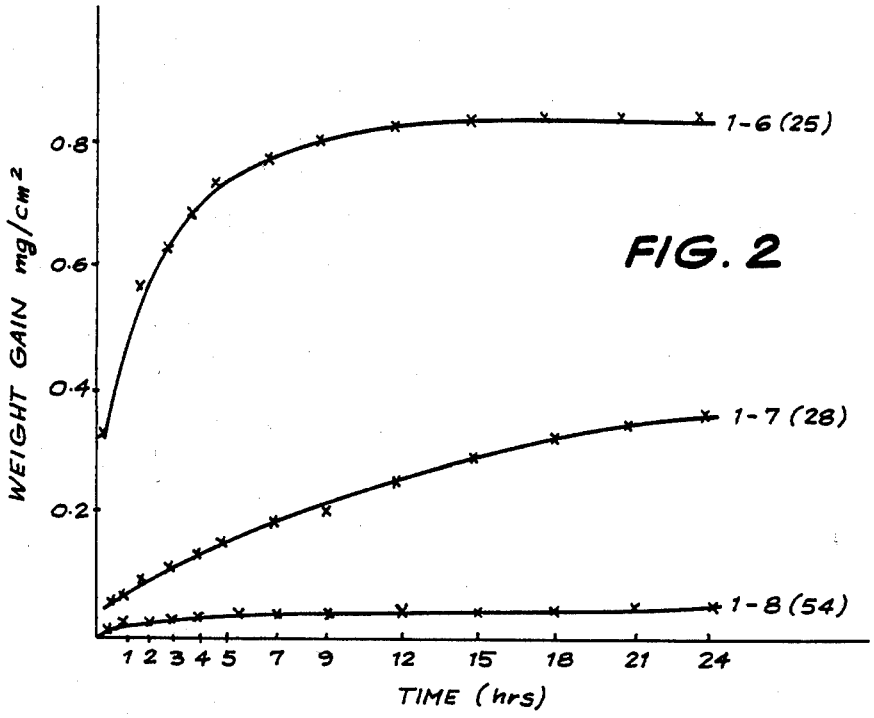
Figures 3, 4:
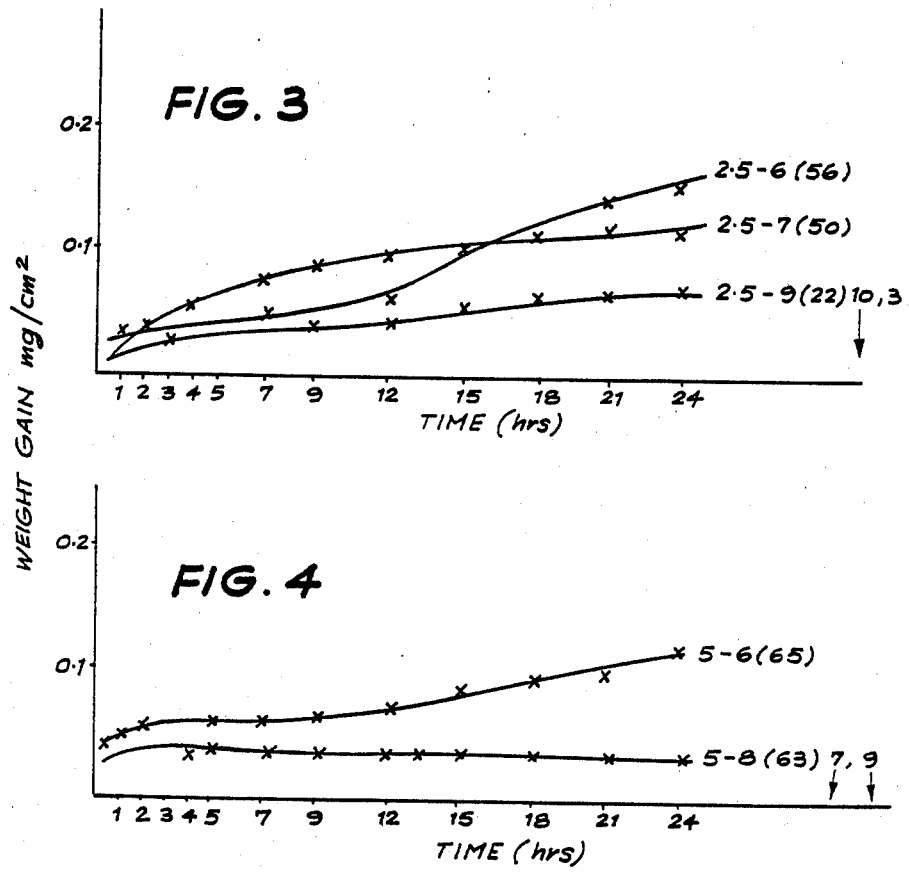
Figure 5:
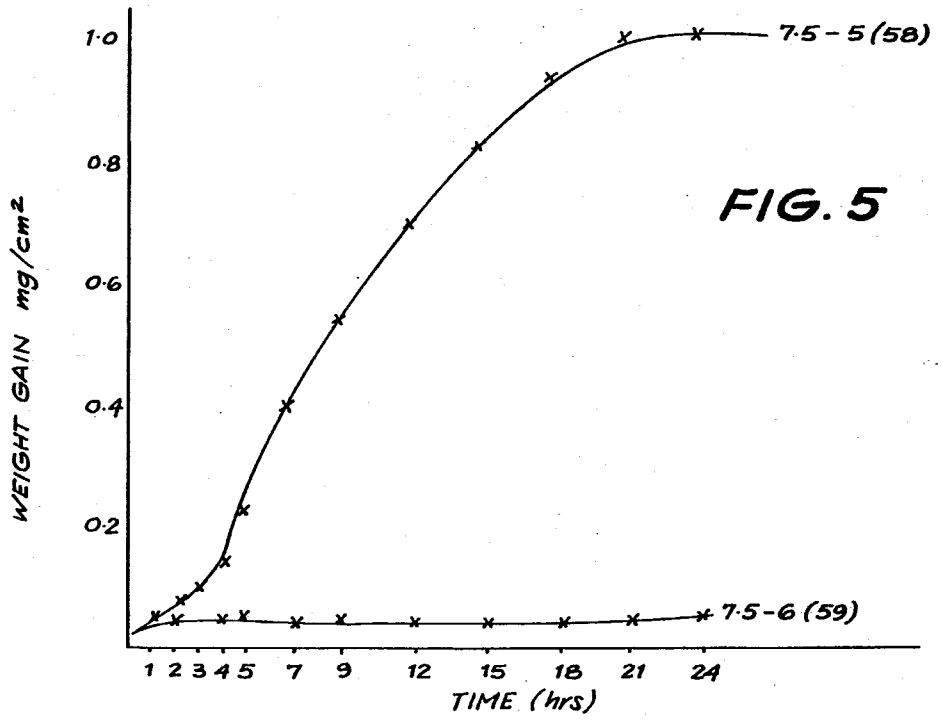
Figure 6:
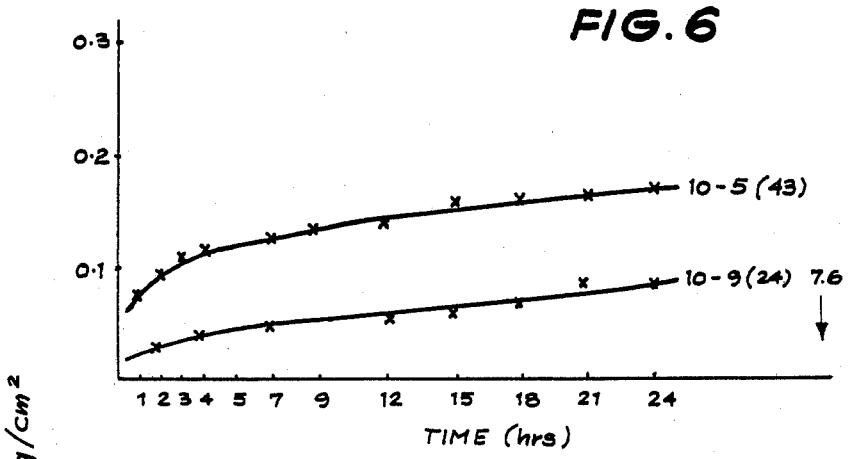
Figure 7:
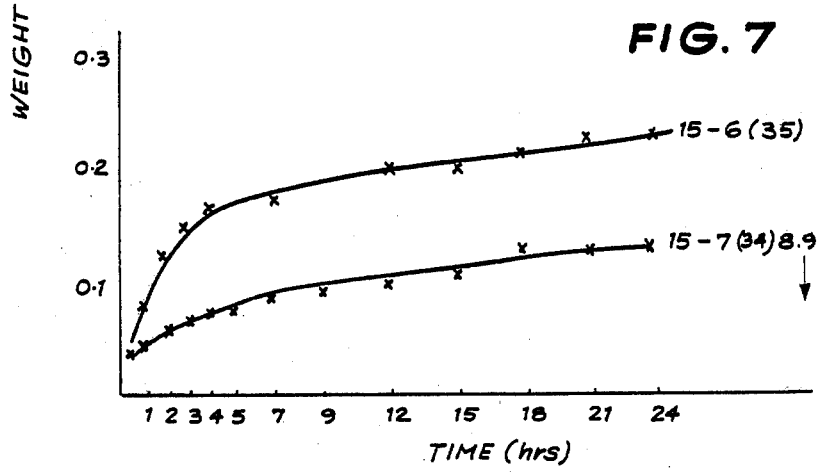
Figure 8:
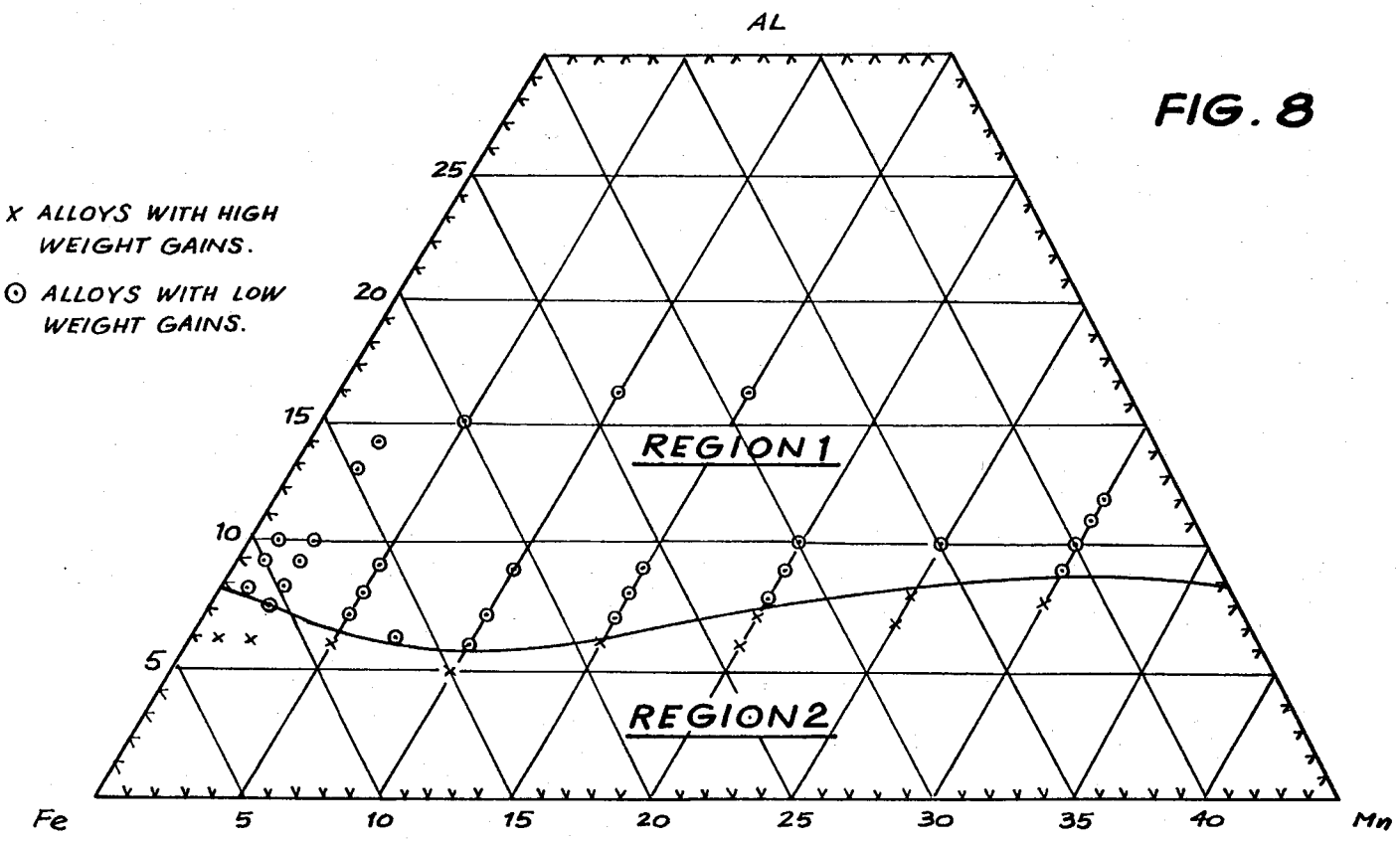

FIGS. 1–7 illustrate graphically kinetic curves showing weight gain per unit surface area versus time for various alloy compositions, wherein:

FIG. 1 represents the alloy Fe-0Mn-7Al (i.e. Fe-7Al)
FIG. 2 represents the alloy Fe-1Mn-XAl
FIG. 3 represents the alloy Fe-2.5Mn-XAl
FIG. 4 represents the alloy Fe-5Mn-XAl
FIG. 5 represents the alloy Fe-7.5Mn-XAl
FIG. 6 represents the alloy Fe-10Mn-XAl
FIG. 7 represents the alloy Fe-15Mn-XAl FIG. 8 is an oxide map determined from 24 hours kinetic data showing the nature of scales formed on Fe-Mn-Al alloys at 800° C., ($PO_2$=200 Torr). "Oxide Mapping" is a system of superimposing oxidation data on alloy phase diagrams to indicate suitable ternary alloy compositions which are oxidation resistant at the temperature for which the map was drawn, thus providing a basis for selecting new alloys.

Figure 9:
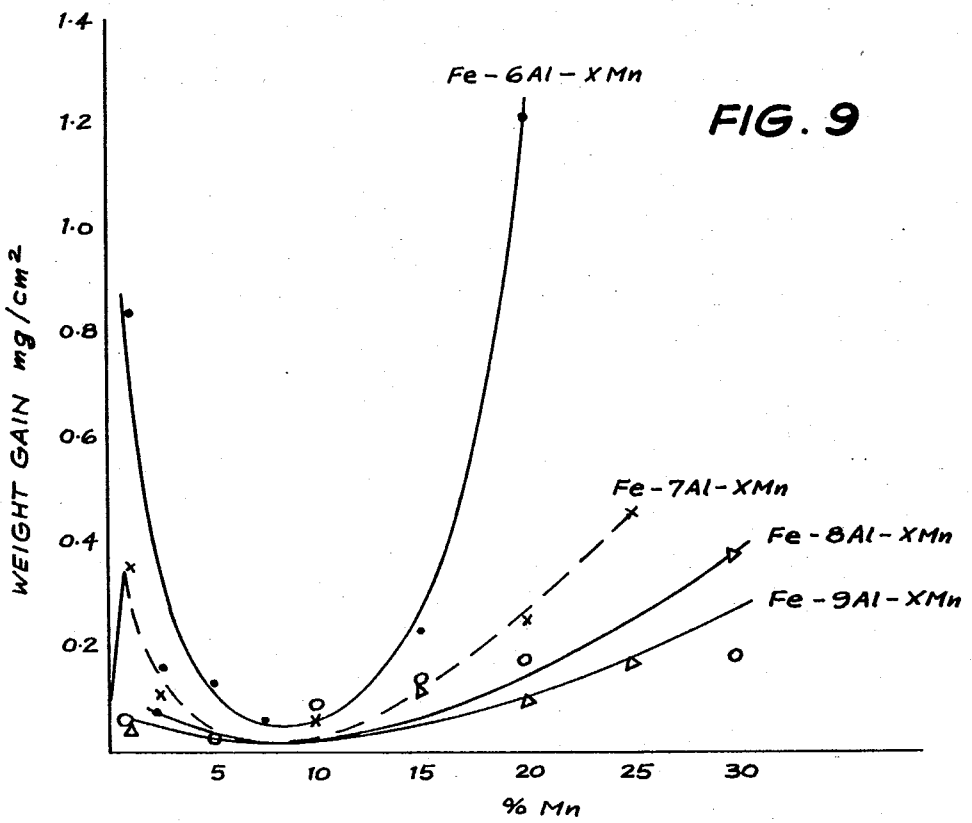
Figure 10:
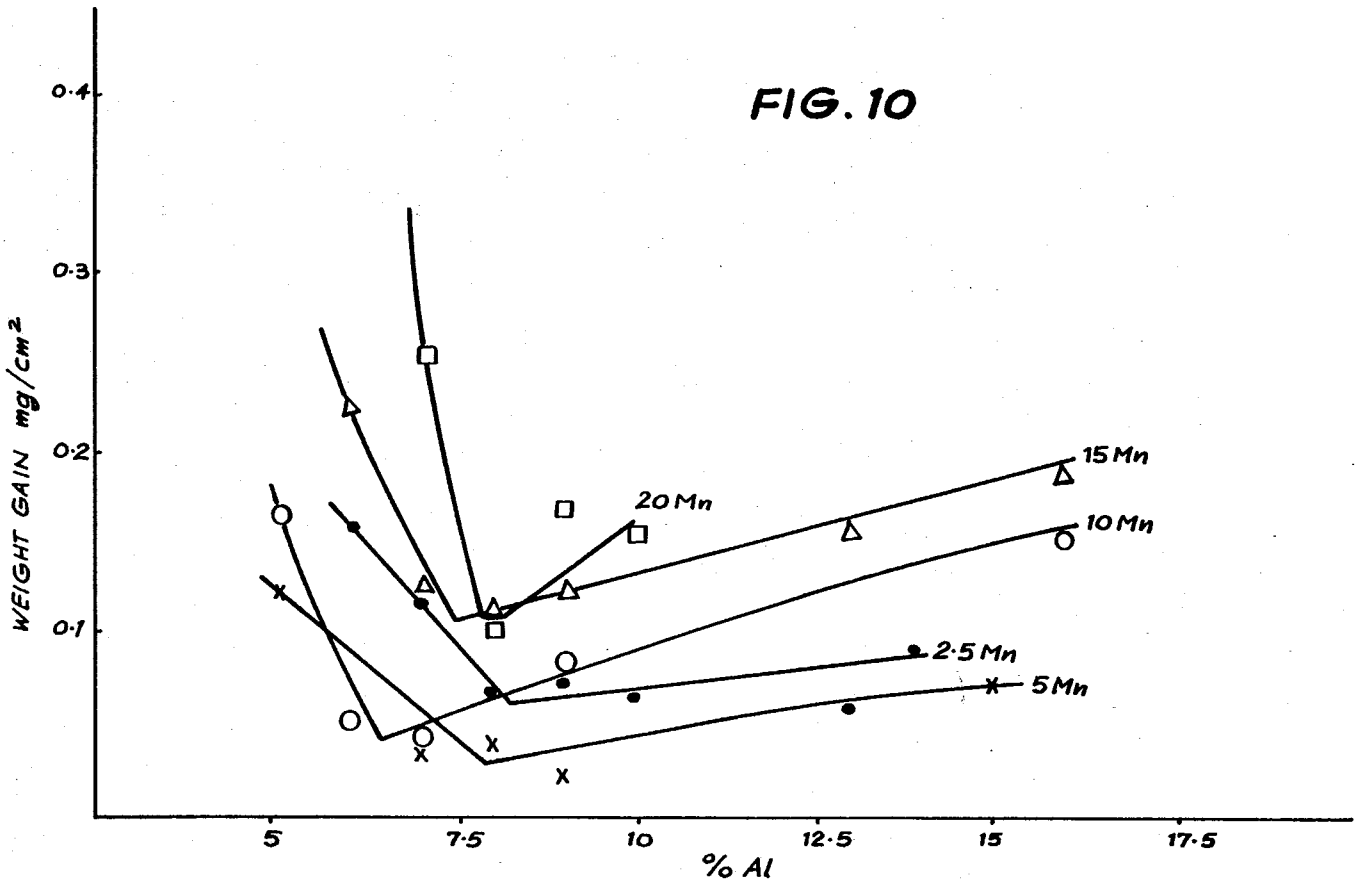

FIGS. 9 and 10 illustrate graphically the effect of variation of the manganese or aluminium content of alloys on their overall oxidation resistance.

The means by which this data was obtained is described as follows.

TABLE 1

| Alloy Description | Kinetic Curve Designation | Wt % Alloy Composition Fe | Mn | Al |
|---|---|---|---|---|
| 0-7 | 0-7 (26) | 93 | 0 | 7 |
| 1-6 | 1-6 (25) | 93 | 1 | 6 |
| 1-7 | 1-7 (28) | 92 | 1 | 7 |
| 1-8 | 1-8 (54) | 91 | 1 | 8 |
| 1-9 | | 90 | 1 | 9 |
| 1-10 | | 89 | 1 | 10 |
| 2-5-6 | 2-5-6 (54) | 91.5 | 2.5 | 6 |
| 2-5-7 | 2-5-7 (50) | 90.5 | 2.5 | 7 |
| 2-5-8 | | 89.5 | 2.5 | 8 |
| 2-5-9 | 2-5-9 (22) | 88.5 | 2.5 | 9 |
| 2-5-10 | | 87.5 | 2.5 | 10 |
| 2-5-13 | | 84.5 | 2.5 | 13 |
| 2-5-14 | | 83.5 | 2.5 | 14 |
| 5-6 | 5-6 (65) | 89 | 5 | 6 |
| 5-7 | | 88 | 5 | 7 |
| 5-8 | 5-8 (63) | 87 | 5 | 8 |
| 5-9 | | 86 | 5 | 9 |
| 5-15 | | 80 | 5 | 15 |
| 7-5-5 | 7.5-5 (58) | 87.5 | 7.5 | 5 |
| 7-5-6 | 7.5-5 (59) | 86.5 | 7.5 | 6 |
| 10-5 | 10-5 (43) | 85 | 10 | 5 |
| 10-6 | | 84 | 10 | 6 |
| 10-7 | | 83 | 10 | 7 |
| 10-9 | 10-9 (29) | 81 | 10 | 9 |
| 10-16 | | 74 | 10 | 16 |
| 15-6 | 15-6 (35) | 79 | 15 | 6 |
| 15-7 | 15-7 (34) | 78 | 15 | 7 |

TABLE II

WEIGHT GAINS PER SQUARE CENTIMETER PER 24 HOURS FOR ALLOYS OXIDIZED AT 800° C. 200 TORR $O_2$

| | Mn | | | | | | | | |
|---|---|---|---|---|---|---|---|---|---|
| Al | 1 | 2.5 | 5 | 7.5 | 10 | 15 | 20 | 25 | 30 |
| 5 | | | | 1.043 | 0.167 | | | | |
| 6 | 0.828 | 0.157 | 0.123 | 0.046 | 0.054 | 0.223 | >1.16* | | |
| 7 | 0.356 | 0.114 | 0.033 | | 0.046 | 0.127 | 0.253 | 0.436 | |
| 8 | 0.041 | 0.067 | 0.038 | | | 0.116 | 0.102 | 0.174 | 0.367 |
| 9 | 0.057 | 0.072 | 0.021 | | 0.085 | 0.123 | 0.166 | | 0.169 |
| 10 | 0.062 | 0.061 | | | | | 0.155 | 0.138 | |
| 11 | | | | | | | | | 0.116 |
| 12 | | | | | | | | | 0.136 |

TABLE II-continued

WEIGHT GAINS PER SQUARE CENTIMETER PER 24 HOURS FOR ALLOYS OXIDIZED AT 800° C. 200 TORR $O_2$

| | Mn | | | | | | | | |
|---|---|---|---|---|---|---|---|---|---|
| Al | 1 | 2.5 | 5 | 7.5 | 10 | 15 | 20 | 25 | 30 |
| 13 | | 0.053 | | | | 0.155 | | | |
| 14 | | 0.091 | | | | | | | |
| 15 | | | 0.074 | | | | | | |
| 16 | | | | | 0.151 | 0.191 | | | |

*Specimen oxidized only for 18 Hours.

EXPERIMENTAL PROCEDURE

Approximately fifty Fe-Mn-Al and several Fe-Mn-Cr-Al alloys were prepared from high purity materials using the technique of levitation melting described by B. Harris and A. E. Jenkins in J. Scientific Instruments (1959) vol 36, p 238 and specimens approximately 7 mm in diameter and 1 mm in thickness were oxidised in the as-cast condition at 800° C. for 24 hours at an oxygen pressure of 200 Torr. In addition to continuously recording the specimen weight during oxidation using a Cahn R. G. electrobalance, the samples were weighed prior to and after oxidation. To determine the effects of temperature and time on the general oxidation behaviour, certain alloys were selected and oxidised for 100 hours at 600°, 800° and 1000° C.

The scale morphologies for all specimens were examined using the scanning electron microscope and pertinent features qualitatively analysed with E.D.A.X.. The specimens were then mounted on edge, sectioned and polished for metallographic examination and electron microprobe analysis. A series of alloys was also heat treated at the temperature of oxidation, quenched and metallographically examined to confirm the phases present at 800° C.

RESULTS

1. Oxidation of Fe-Mn-Al Alloys (a) 24 Hour Oxidation

The weight gains obtained for the alloys oxidised for 24 hours at 800° C. are summarised in Table II and plots of weight gain versus time data for typical alloys which were considered to form protective scales is shown in FIGS. 1–7.

From this data the Fe-Mn-Al oxide map for 800° C. was drawn (FIG. 8). In order to optimise the composition required to form protective scales, the weight gains after 24 hours oxidation at 800° C. as a function of manganese content are plotted in FIG. 9 for a series of alloys with fixed aluminium levels. Likewise, in FIG. 10, weight gains are plotted as a function of aluminium for alloys with fixed manganese concentrations.

From this data it is shown that the most oxidation resistant alloys for service at 800° C. lie within the composition range Fe-(6-10)Al-(5-10)Mn. Alloys with compositions in region 1 of the oxide map in FIG. 8 formed protective scales that were predominantly thin alumina. Alloys which contained higher levels of aluminium formed very small oxide nodules which were found to be composed almost exclusively of manganese oxide, even on alloys which contained as little as 1% manganese. Alloys which exhibited breakaway kinetics contained slightly less aluminium than the critical amount required for the formation of protective scales. Scales consisted of alumina and large iron rich oxide nodules or smaller manganese rich oxides depending upon the manganese content of the alloy. A transition from one oxide type to the other occurred with additions of between 5 and 10% manganese. The structures of the iron rich nodules were very similar to those of nodules formed on binary Fe-Al alloys, whereas manganese rich oxides had, in addition to a white iron rich oxide phase, ($Fe_2O_3$), a grey external phase highly enriched in manganese. As the alloy manganese concentration increased, the amount of $Fe_2O_3$ progressively decreased and was no longer observed in scales formed on those alloys which contained more than 15% manganese.

Scale morphologies developed on high manganese alloys 15–30% Mn) which contained insufficient aluminium to form protective $Al_2O_3$ scales were of two types. Those formed on alloys having aluminium levels slightly below the critical level required for protection, were mainly alumina with some bulky manganese rich oxides also. These grew as linear arrays at sites where plates of austenite in the alloy intersected the surface. Scales formed on alloys containing still lower levels of aluminium and higher proportions of austenite in the structure were often stratified and grew above an austenitic ferrite depleted surface layer.

Electron microprobe analysis in conjunction with metallographic examination of etched cross-sections of both, oxidised specimens and specimens quenched from 800° C. showed that similar precipitated plates and depleted surface layers contained considerably lower levels of aluminium compared to the other alloy phase.

(b) 100 Hour Oxidation

Two alloys, (Fe-10Mn-6Al and Fe-20Mn-8Al) were chosen from the oxide map (FIG. 8) because they had aluminium levels close to those required for protective scale formation and manganese levels representative of the range of the alloys of the invention. These were oxidised for 100 hours in 200 Torr $O_2$ at 600°, 800° and 1000° C. From their weights before and after oxidation, the weight gains were calculated and are presented in Table III.

TABLE III

| Alloy Composition | | Weight Gain (mg cm$^2$) | | |
|---|---|---|---|---|
| Fe-% | Mn-% Al | 600° C. | 800° C. | 1000° C. |
| 10 | 6 | .171 | .117 | .450 |
| 20 | 8 | .101 | .242* | .253* |

*Weight gains unreliable due to oxide spallation.

Both alloys formed non-protective scales at 600° C. with similar morphologies. These were mainly $Al_2O_3$ interspersed with numerous manganese rich oxides. At 800° C. scales formed on the 10–6 alloy were amost entirely alumina and were adherent, except for areas around small oxide protrusions where the scale lifted and buckled above the substrate. Scales formed on the 20–8 alloy at 800° C. were similar to those formed at 600° C. and spalled on cooling as did those formed at 1000° C. Convoluted scales with almost identical morphologies and composed of an outer layer enriched in manganese and aluminium, and an inner $Al_2O_3$ layer, formed on both alloys oxidised at 1000° C.

2. Oxidation of Fe-Mn-Al-Cr Alloys

The weight gains and composition of the alloys oxidised for 24 and 100 hour periods at 800° C. in 200 Torr $O_2$ are shown in Table IV.

Alloys which contained less than 5% aluminium had relatively high weight gains and were not oxidation resistant unless alloyed with moderately high levels of chromium, e.g. Fe-10Mn-4Al-12Cr. High levels of manganese (15%) also promoted high weight gains and breakaway behaviour.

For any particular group of alloys with varying manganese levels, the lowest weight gains and hence the most protective scales were formed on those alloys within the composition range Fe-(<15%)Mn-(5%)Al-(>5%)Cr. Alloys within this range formed thin adherent protective alumina scales after 24 hours oxidation. Alloys with compositions outside the range formed non-adherent extremely convoluted scales rich in all four alloying elements. Small areas of scales of this type were also observed on alloys within the above range after 100 hours of oxidation.

TABLE IV

| Alloy Composition | | | Weight Gain at 800° C. (mg cm$^2$) | |
|---|---|---|---|---|
| Fe-% | Mn-% | Al-% Cr | 24 hours | 100 hours |
| 5 | 4 | 5 | .292* (18 hrs) | — |
| 5 | 5 | 5 | .068 | .327 |
| 7.5 | 4 | 5 | .196 | .420 |
| 7.5 | 5 | 3 | .122 | .493 |
| 7.5 | 5 | 5 | .063 | .215 |
| 10 | 4 | 5 | .115 | — |
| 10 | 4 | 12 | .061 | — |
| 15 | 5 | 5 | 2.663 | — |

Experiments showed that chromium additions lowered the amount of aluminium required for protective alumina scale formation on Fe-Mn-Al alloys. Although Fe-5Cr-5Al is totally oxidation resistant at 800° C. Fe-Mn-5Al alloys which contained 5% chromium showed signs of scale failure after 100 hours oxidation and thus slightly higher levels of aluminium were required. It has been shown using the oxide mapping technique in conjunction with structural examination that austenitic alloys were not as satisfactory as ferritic alloys and do not form protective $Al_2O_3$ scales. The critical level of aluminium in these alloys may be reduced to approximately five percent by the addition of about 5% chromium without loss of oxidation resistance. This results in alloys with high ductility at working temperature and reasonably maleability at room temperature. Some scale deterioration that may occur on these rather simple alloys can be eliminated using minor additions of rare earth elements and some degree of high temperature strengthening may also be possible by the addition of carbon to form carbides. Finally, the resistance of these alloys to mixed gasses which contain carbon and sulphur should be much better than the stainless steels.

Although the invention has been described above with reference to preferred embodiments and examples, it will be appreciated that numerous variations, modifications or alternatives may be substituted for specifically described features, without departing from the spirit or scope of the invention as broadly described.

What I claim is:

1. A substantially ferritic alloy consisting essentially of aluminium—4 to 9%,
manganese—3 to 15%,
chromium—0 to 6%, and
iron—balance to 100%.

2. The alloy of claim 1 wherein the chromium is present.

3. The alloy of claim 1 consisting essentially of aluminium—about 5%,
manganese—<15%,
chromium—>5%, and
iron—balance to 100%.

4. The alloy of claim 1 consisting essentially of
aluminium—about 5%,
manganese—about 5%,
chromium—about 5%, and
iron—balance to 100%.

5. The alloy of claim 1 consisting essentially of
aluminium—about 5%,
manganese—about 7.5%,
chromium—about 5%, and
iron—balance to 100%.

6. A substantially ferritic alloy consisting essentially of
aluminium—6 to 10%,
manganese—5 to 10%, and
iron—balance to 100%.

7. The alloy of any one of claims 1 through 6 wherein there is also present at least one of the group consisting of carbon and at least one rare earth element.

8. A corrosion and oxidation resistant article consisting essentially of the alloy of any one of claims 1 through 6.

9. A corrosion and oxidation resistant article consisting essentially of the alloy of claim 1 or 2 wherein there is also present at least one of the group consisting of carbon and at least one rare earth element.

* * * * *